United States Patent [19]

Sakamoto et al.

[11] 4,043,801

[45] Aug. 23, 1977

[54] METHOD OF SIMULTANEOUSLY CONTROLLING TEMPERATURE AND CARBON CONTENT OF MOLTEN STEEL AT THE END-POINT IN OXYGEN TOP-BLOWN CONVERTER

[75] Inventors: Eiichi Sakamoto, Kamakura; Masanobu Kubo, Yokohama; Takashi Yasui, Kamakura; Katsuya Suzuki, Yokohama; Katsuhiko Tachibana, Kamakura, all of Japan

[73] Assignee: Nippon Kokan Kabushiki Kaisha, Tokyo, Japan

[21] Appl. No.: 598,756

[22] Filed: July 25, 1975

Related U.S. Application Data

[63] Continuation-in-part of Ser. No. 420,470, Nov. 30, 1973, abandoned.

[30] Foreign Application Priority Data

Dec. 11, 1972 Japan ..... 47-123417

[51] Int. Cl.[2] ..... C21C 5/30

[52] U.S. Cl. ..... 75/60

[58] Field of Search ..... 75/60, 59

[56] References Cited

U.S. PATENT DOCUMENTS

| | | | |
|---|---|---|---|
| 3,871,871 | 3/1975 | Denis | 75/60 |

FOREIGN PATENT DOCUMENTS

| | | | |
|---|---|---|---|
| 44,462 | 4/1970 | Australia | 75/60 |
| 8,126 | 1/1968 | Australia | 75/60 |
| 65,803 | 1/1971 | Australia | 75/60 |

*Primary Examiner*—Peter D. Rosenberg
*Attorney, Agent, or Firm*—Flynn & Frishauf

[57] ABSTRACT

In the refining of steel by an oxygen topblown converter, the temperature and carbon content of molten steel are simultaneously measured by a sensor at a predetermined time before the end point, whereby in accordance with the difference between a calculated carbon content at the endpoint obtained by processing the measured values and a target carbon content at the end-point, the oxygen quantity to be blown in at the end-point and the coolant requirement or the pattern of soft-blow are computed to simultaneously control the temperature and carbon content of the molten steel at the end-point.

6 Claims, 7 Drawing Figures

Note:
Abscissa represents the number of heats and ordinate represents temperature accuracy and carbon content accuracy.

METHOD OF SIMULTANEOUSLY CONTROLLING TEMPERATURE AND CARBON CONTENT OF MOLTEN STEEL AT THE END-POINT IN OXYGEN TOP-BLOWN CONVERTER

This application is a continuation-in-part of Ser. No. 420,470, filed Nov. 30, 1973, and now abandoned.

BACKGROUND OF THE INVENTION

The present invention relates generally to oxygen top-blown converters and more particularly to a control method therefor wherein during the converter oxygen blowing operation a sensor is immersed in the steel bath to measure the temperature and carbon content of the steel bath, whereby on the basis of the measured values the steel bath temperature and carbon content at the end point of the oxygen blowing are simultaneously controlled.

In the past, known methods of the type designed to control the temperature and carbon content of molten steel at the end-point in oxygen top-blown converters are grouped into two broad classes; (1) those in which the temperature or carbon content of the steel bath is measured by a sensor immersed in the steel bath to simply control the temperature or carbon content at the end-point in accordance with the measured temperature or carbon content, and (2) those in which the temperature measurement is effected by means of a sensor immersed in the steel bath and the carbon content is measured by means of a separate sensor or from information obtained from other than the steel bath, e.g. the analysis of the waste gases, whereby to simultaneously control the temperature and carbon content of the steel bath at the end-point.

A disadvantage of the former methods is that these methods are after all the single control methods and therefore either the temperature or the carbon content at the end-point is controlled alone. A disadvantage of the latter methods is that due to the use of two or more sensors or the use of the information obtained from the analysis of waste gases, not only more equipment and labor are required, but also their successive use over a long period of time is difficult in consideration of the accuracy and maintenance of the instruments.

SUMMARY OF THE INVENTION

It is an object of the present invention to overcome the foregoing difficulty. The method according to the present invention therefore comprises a method of simultaneously controlling the temperature and carbon content of molten steel at the end-point in oxygen top-blown converters.

The essence of the present invention is as follows.

The sensor used with this invention is of the type which has been developed by the inventors and for which a patent has been applied for in Japan. That is, the sensor is one which is capable of simultaneously measuring the temperature and carbon content of molten steel and which comprises a solidification temperature measuring thermocouple protected by a silica tube and provided in a sampling vessel attached to a measuring lance and a molten steel temperature measuring thermocouple mounted on the outer side of the sampling vessel bottom. The sensor is designed to provide a satisfactory protection for the compensating lead wires.

In accordance with the present invention, an illustrative sequence of operations in an oxygen top-blown converter is as follows: (a) the preparation of raw materials required for a given heat is carried out in such a manner that the temperature of the molten steel at the end-point is slightly higher than a target temperature at the end-point; (b) after the blowing has been begun, the amount of oxygen is calculated and indicated in accordance with a static model so that the carbon content of the molten steel amounts to a predetermined value within a range of 0.50 to 1.00% depending on the desired carbon content of the steel to be produced (e.g., 0.50% for the low carbon and intermediate carbon steels); (c) upon completion of the blowing of this amount of oxygen, a measuring lance is introduced into the molten steel so that the steel bath temperature and the liquidus temperature are simultaneously measured by a sensor and then the steel bath temperature and the steel bath carbon content are read out by an automatic reading-out program; (d) and immediately following the measuring, a forecast heating factor and decarburization parameters are calculated to determine the amount of oxygen required for causing the temperature at the end-point to hit the target temperature at the end-point when the blowing operation continued under the conditions existing at the time of the measuring (i.e., the quantity of oxygen blown in for raising the temperature up to an estimated level after the measuring), and then a calculated carbon content at the end-point is calculated from the thus calculated oxygen quantity and the decarburization parameters.

At this instant, a judgement is made as to whether, at the end of the blow of this calculated amount of oxygen blown after measuring, (i) the calculated carbon content at the end-point is within the allowable range of carbon content dependent on the desired steel (i.e., type *a* in FIG. 1), (ii) the calculated carbon content at the end-point is predicted to be excessively high (i.e., type *b* in FIG. 1 where the charging of a coolant is required), and (iii) the calculated carbon content at the end-point is predicted to be excessively low (i.e., type *c* in FIG. 1 where the soft-blow is required), and the control corresponding to the judged type is effected.

According to the present invention, heating factor A (Ton.° C/Nm³ of oxygen) is defined as $$A = (W_T \Delta T)/Q$$

where $\Delta Q$ = the quantity of oxygen blown in for raising the temperature up to an estimated level after the measuring (Nm³)

$W_T$ = the weight of total charge (Ton)

$\Delta T$ = the temperature rise after measuring (° C)

The forecast heating factor A′ is obtained from the following equation and the target end-point temperature is calculated from this equation:

$$A' = \alpha_o + \alpha_1 E_o + \alpha_2 E_B + \alpha_3 E_{EA} + \alpha_4 E_L + \alpha_5 \Delta W_C + \alpha_6 \Delta W_{FE} \quad (1)$$

where $A'$ = forecast heating factor (Ton.° C/Nm³ of oxygen)

$E_O$ = the calories possessed by the initial charge (K cal)

$E_B$ = the calories possessed by the charge at the time of measuring (K cal)

$E_{EA}$ = the target calories possessed by the charge at the end point (K cal)

$E_L$ = loss calories between measurement and end-point (K cal)

$\Delta W_C$ = the amount of decarburization (Ton)

$\Delta W_{Fe}$ = the amount of oxidized molten iron (Ton)

$\alpha_o$, $\alpha_1$, $\alpha_2$, $\alpha_3$, $\alpha_4$, $\alpha_5$ and $\alpha_6$ are constants In a typical example, a mean value of A' is 10.9 T.C°/Nm³ and its standard deviation is 2.1 T.C°/Nm³.

The constants of the above equation were obtained by determining the correlation between the heating factor A' and its influencing factors $E_o$, $E_B$, $E_{EA}$, $E_L$, $\Delta W_C$ and $\Delta W_{Fe}$ as obtained in a statistical analysis of a great deal of practical data corresponding to A, $E_o$, $E_B$, $E_{EA}$, $E_L$, $\Delta W_C$ and $\Delta W_{Fe}$ measured in many operations conducted over a long period of time.

By substituting the values of $E_o$, $E_B$, $E_{EA}$, $E_L$, $\Delta W_C$ and $\Delta W_{Fe}$ in each operation into the above equation (1), the forecast heating factor A' can be calculated. Since the constants $\alpha_o$, $\alpha_1$, $\alpha_2$, $\alpha_3$, $\alpha_4$, $\alpha_5$, and $\alpha_6$ are statistical figures, they vary according to characteristics such as, for example, the equipment dimensions, etc. and their operational conditions (depending on the period of the statistical calculation). Therefore, these constants are renewed at times according to later actual results obtained. Thus, the quantity of oxygen blown in for raising the temperature up to an estimated level after the measuring is calculated from following equation:

$$\Delta Q = (W_T \cdot \Delta T)/A' \qquad (2)$$

If it is assumed that there is a relation between the decarburization rate and the carbon content as shown in FIG. 3 the decarburization rate is given by the following equation:

$$v = -\frac{d(W_{ST} \cdot \frac{C}{100})}{dQ} = V\left\{1 - \exp(-\frac{C-C_O}{C_P})\right\} \qquad (3)$$

where $v$ = decarburization rate (KgC/Nm³ of oxygen)

$W_{ST}$ = the weight of molten steel (Kg)

$Q$ = integral oxygen quantity (Nm³)

$C$ = carbon content (%)

$V$ = decarburization rate during the maximum decarburization period (KgC/Nm³ of oxygen)

$C_P$ = curve parameter (%)

$C_O$ = carbon content at critical decarburization (%)

The inventors term the V, $C_P$ and $C_O$ as the decarburization parameters. $C_P$ is a constant of carbon content which is determined according to the decarburization curve which varies depending on the conditions of blowing, as shown in FIG. 3.

In FIG. 3, when a perpendicular is drawn to the axis of abscissa from the intersection point ($x$) of the tangential line of the decarburization curve at the point of Co and the line drawn from the point of V parallel to the axis of abscissa, the intersection point of said perpendicular and the axis of abscissa may be represented by $C_1$. In this case $C_P$ is the value of carbon content as shown by the difference between $C_1$ and Co.

When V and Co are fixed, a smaller value of $C_P$ indicates a more intense decarburization phenomenon at the final stage of blowing than a larger value of $C_P$.

In the present invention, the decarburization rate is low at the early stage of the operation and gradually increases to the maximum and decreases at the final stage of the operation. The accuracy of the control action on decarburization depends on whether the decarburization rate is decreased rapidly or slowly. $C_P$ is a parameter which indicates the rate of the above-mentioned decrease (characteristic of decarburization curve). $C_P$ depends on the operating conditions of the factory. In a typical example of the present invention it is about 0.28%. $C_o$ is a carbon content at which decarburization no longer proceeds even when oxygen is further blown in.

Further, assuming the following $C_B$ = carbon content at the time of measuring (%)

$C_{EA}$ = target carbon content at the end-point (%)

$C_{EC}$ = calculated carbon content at the end-point (%)

the following equation is obtained from equation (3), $$\Delta Q = -\int_{C_B}^{C_{EA}} \frac{d(W_{ST} \cdot \frac{C}{100})}{V\left\{1-\exp(-\frac{C-C_O}{C_P})\right\}} = \frac{W_{ST} \cdot C_P}{100V} \ln\left\{\frac{\exp(\frac{C_B-C_O}{C_P})-1}{\exp(\frac{C_{EA}-C_O}{C_P})-1}\right\}$$

Therefore $$C_{EC} = C_O + C_P \cdot \ln[1 + \left\{\exp(\frac{C_B-C_O}{C_P})-1\right\} \cdot \exp\left\{-\frac{100V \cdot \Delta Q}{W_{ST} \cdot C_P}\right\}] \qquad (4)$$

where $C_{EC}$ is the calculated carbon content (%) at the end-point. Among the decarburization parameters, the $C_O$ is a constant determined by the actual results of the past operations, and the $V$ and $C_P$ can be determined experimentally as functions of the refining conditions. Therefore, if the carbon content $C_B$ during the blowing is measured, the calculated carbon content $C_{EC}$ at the end-point can be calculated. The control action is determined in accordance with the difference between the calculated carbon content at the end-point and a set target carbon content.

The obtained calculated carbon content $C_{EC}$ is compared in the computer with the target carbon content $C_{EA}$.

In the case where $C_{EC}$ becomes equal to $C_{EA}$ (the tolerance is taken into consideration):

The blowing of oxygen is continued up to the end point without changing the initially calculated condition. The oxygen quantity practically blown in after the measuring does not differ from ΔQ calculated in the midst of the controlling.

In the case where $C_{EC}$ is larger than $C_{EA}$:

1. A calculation according to the following equation is made immediately. The calculated new $\Delta Q_C$ (quantity of oxygen to be blown in after the measuring) is actually blown in up to the end point.

(5)

-continued $$\Delta Q_C = \frac{W_{st} \cdot C_P}{V} \ln \frac{\exp\left(\frac{C_B - C_O}{C_P}\right) - 1}{\exp\left(\frac{C_{EA} - C_O}{C_P}\right) - 1}$$

In the above equation, $\Delta Q_C$ is the finally corrected quantity of oxygen to be blown in after the measuring in replacement of the previously calculated $\Delta Q$. The symbols used in the above equation were defined previously hereinabove.

2. The coolant is then charged while oxygen in an amount of $\Delta Q_C$ is being introduced.

The coolant quantity is calculated by the following equation:

$$\Delta W_{Ct} = \frac{\frac{A \cdot \Delta Q_C}{W_{ST}} - T_{EA} + T_B}{Z} \quad (6)$$

where $\Delta W_{Ct}$ is coolant quantity, (kg of coolant/ton of steel);

Z is the cooling capacity. (° C × ton of steel/kg of coolant); and the other symbols in equation (6) are the same as those previously defined.

$$Z \text{ is cooling capacity, } \left(\frac{°C \times \text{ton of steel}}{\text{kg of coolant}}\right)$$

For instance, in a case where killed steel scrap containing 0.08% is used as the coolant, Z can be calculated as follows:

$$Z = 1.6 \times \frac{°C \times \text{ton of steel}}{\text{kg of coolant}}$$

In the case where $C_{EC}$ is smaller than $C_{EA}$:

This case is rare in the controlling method according to to the present invention, because the charge to the converter has already been adjusted at the beginning of the operation so that the coolant charging type control as stated in the case where $C_{EC}$ is larger than $C_{EA}$ may be carried out.

In accordance with the present invention, the required raw materials are prepared so that the temperature of the molten steel at the end-point becomes slightly higher than the target temperature at the end-point, because, when the results of the measurement by the sensor indicates the soft-blow type, the time from the measurement by the sensor to the end point is 2 to 3 minutes and thus the effects of the soft-blow are naturally limited. For this reason, the bath temperature is maintained slightly higher at the very outset of the initial blow and the raw materials are prepared to obtain the temperature at the end-point slightly higher than the target temperature at the end-point so that the proper temperature and carbon content at the end-point are provided even when the soft-blow is used. Further, the temperature and carbon content of the steel bath are measured upon completion of blowing the required amount of oxygen for obtaining a predetermined steel bath carbon content in accordance with the desired carbon content of the steel to be produced, because firstly the temperature rise of the steel bath varies even for the same amount of oxygen blown if the steel bath composition at the time of measuring is not constant and therefore the hitting accuracy of the temperature at the end-point will be deteriorated if the measurements are not effected when the steel bath composition is substantially the same, and secondly 2 to 3 minutes will be needed for the effective lance action in the case of the soft-blow type. Further, the coolant used in the control of this invention may be of the ordinary type (e.g., scrap).

Figure 1:
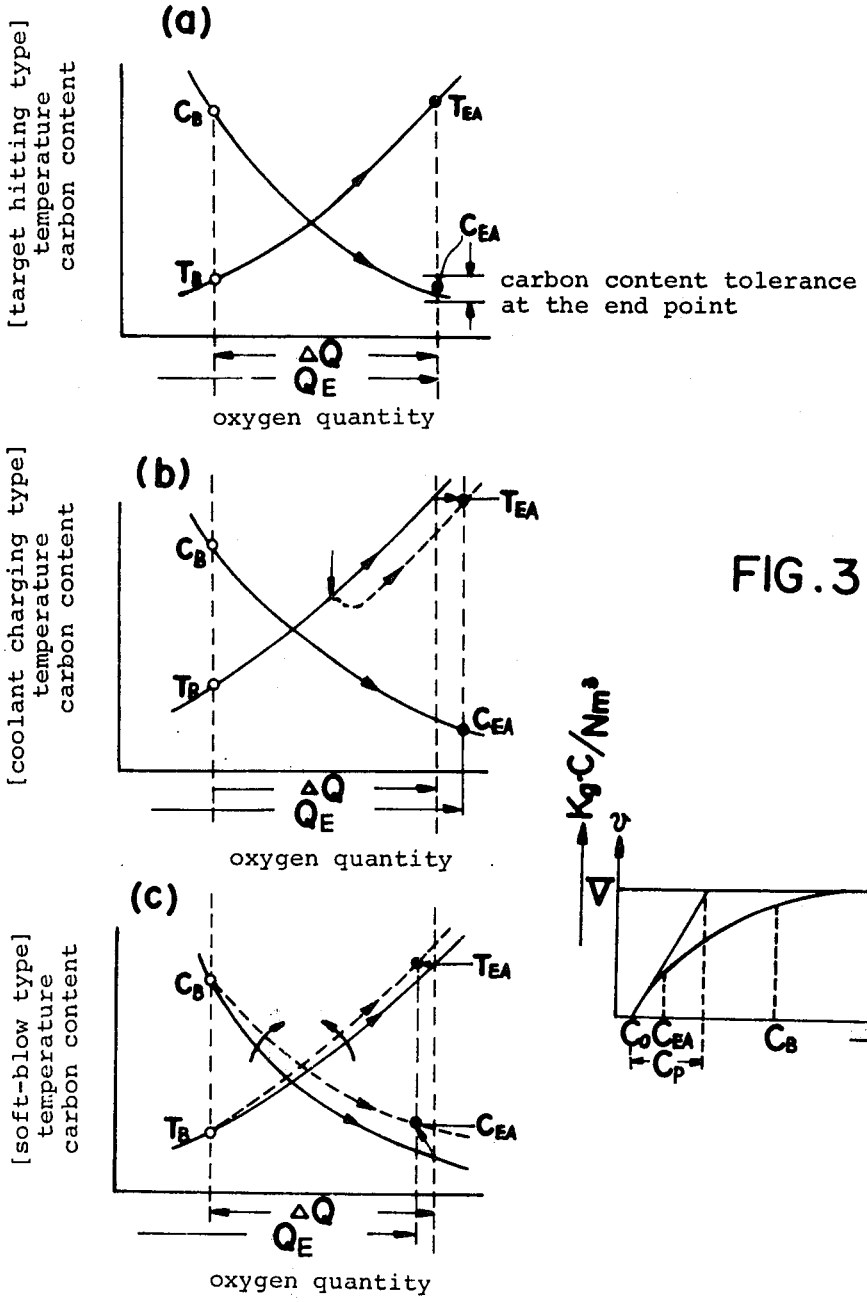
FIGS. 1*a*, 1*b* and 1*c* show three different control patterns classified according to the temperature and carbon content of steel bath at the end-point.
Figure 2:
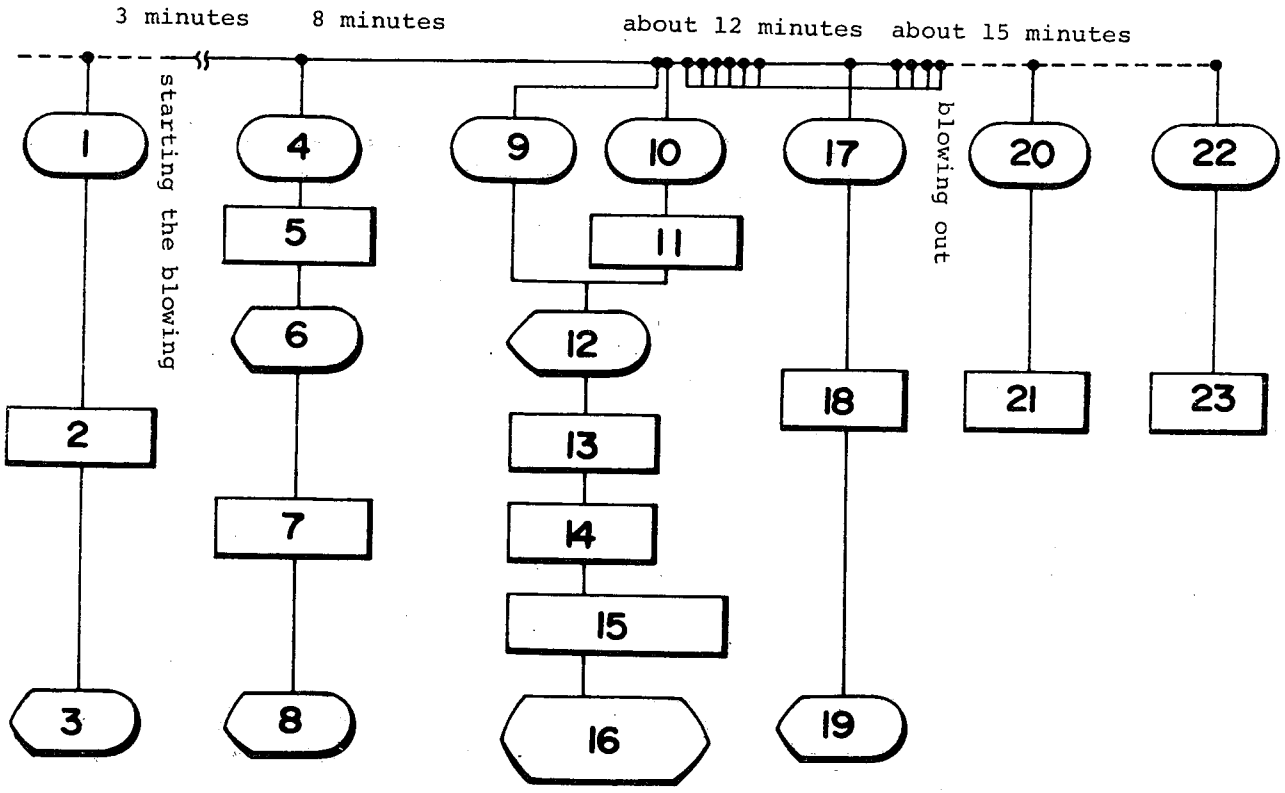

Symbols in FIG. 1 indicate the following:

$\Delta Q$ = the quantity of oxygen blown in for raising the the temperature up to an estimated level after the measuring $Q_E$ = the oxygen quantity to be blown in at the end-point $T_B$ = temperature at the time of measuring $C_B$ = carbon content at the time of measuring $T_{EA}$ = target temperature $C_{EA}$ = target carbon content FIG. 2 is a time chart of an exemplary control system for performing the novel method of the present invention.

Numerals in FIG. 2 indicate the following:

1 = molten iron temperature interruption
2 = heat balance calculation
3 = raw material indication
4 = 8 minutes interruption after starting the blowing
5 = data check
6 = data error indication
7 = oxygen quantity calculation for sensor immersion
8 = oxygen quantity indication
9 = molten steel temperature interruption
10 = liquidus temperature interruption
11 = carbon content calculation by calibration curve
12 = measured temperature and carbon content indication
13 = heating factor and decarburization parameter calculation
14 = judgement of type *a*, *b* or *c*
15 = oxygen quantity, coolant quantity and soft-blow pattern calculation at the end-point
16 = oxygen quantity, coolant quantity and soft-blow pattern indication at the end-point
17 = interruption for every 40 $Nm^3$
18 = temperature rise and decarburization calculation
19 = calculated temperature and carbon content indication
20 = temperature interruption at the end-point
21 = heating factor deviation smoothing calculation
22 = carbon content interruption at the end-point
23 = decarburization parameter deviation smoothing calculation Note 1: Measuring time molten steel temperature and liquidus temperature are automatically read out by reading-out routine.

Note 2: Deviation smoothing values for heating factor and decarburization parameters are settable by setting board.

Figure 3:
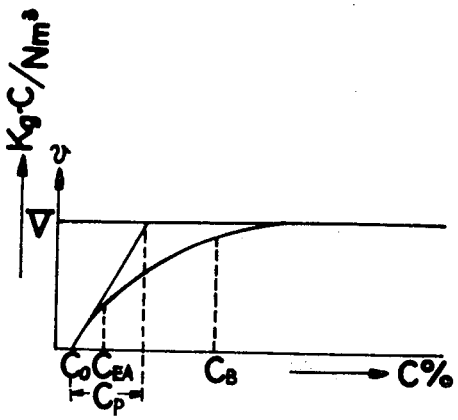

FIG. 3 is a graph showing the relationship between the decarburization rate and carbon content.

Figure 4:
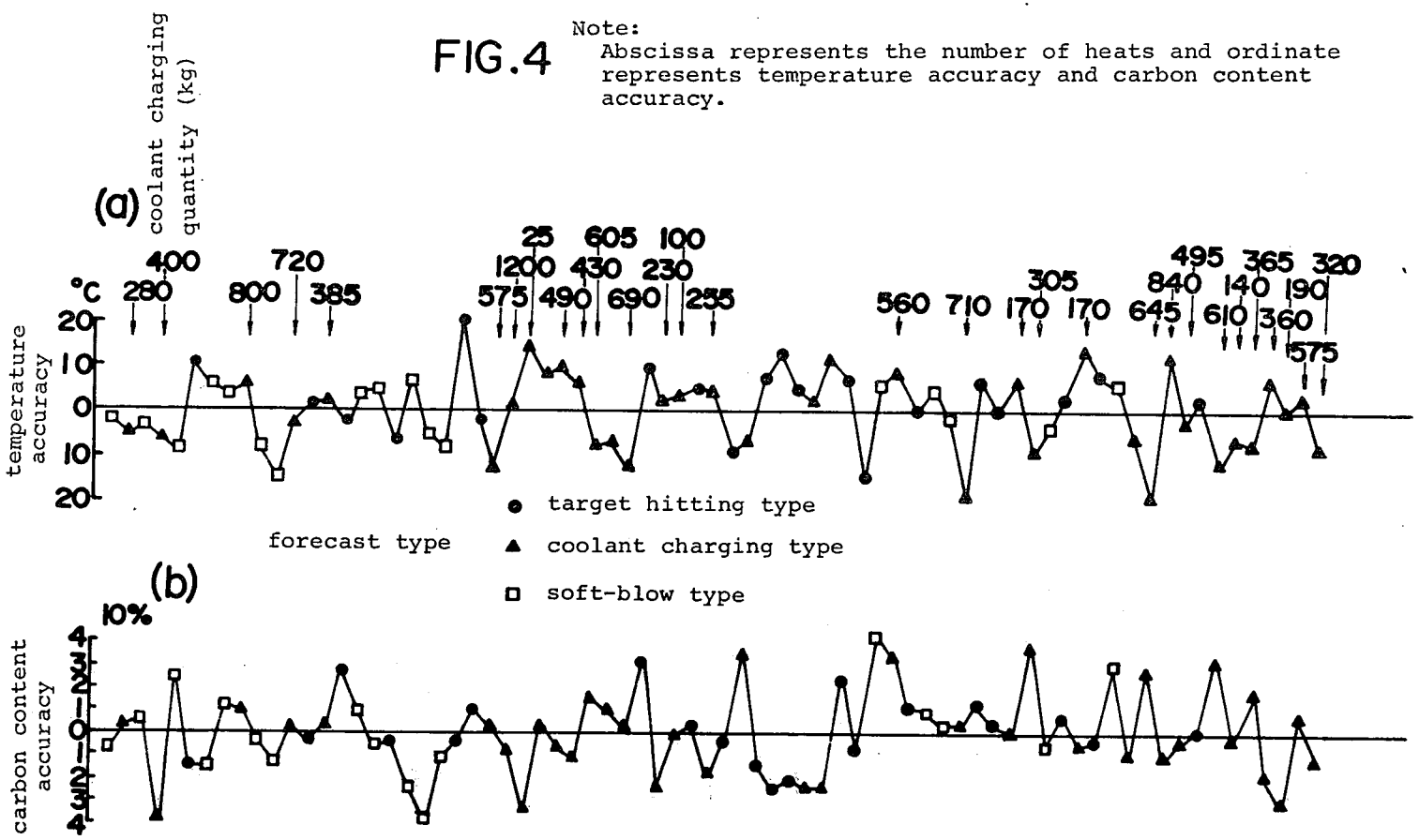

FIGS. 4*a* and 4*b* respectively show the number of heats and temperature accuracy and the carbon content accuracy in the successive operation of a converter in accordance with the method of this invention.

DETAILED DESCRIPTION OF THE INVENTION

The present invention is performed by the control system shown in FIG. 2 which provides very accurate control of the temperature and carbon content of molten steel at the end-point.

The following example describes in greater detail the application of the novel method of this invention.

A converter was initially charged with 82.8 tons of molten pig iron and 18.7 tons of scrap and the temperature of molten pig iron at the time was 1,280° C. Since the desired steel was an intermediate carbon steel, an integral oxygen quantity of 4,060 $Nm^3$ as calculated in accordance with a static model was blown and the temperature and carbon content of the steel bath at that time were measured by means of a sensor. The bath temperature and carbon content thus measured were respectively 1,584° C and 0.46%.

These values were processed in the control system of FIG. 2 in accordance with the previously described equations and the necessary control action was performed. In this operation, the quantity of the coolant (scrap) charged was 320 Kg, the amount of oxygen blown after measuring was 660 $Nm^3$ (the integral oxygen quantity blown up to the end point was 4.720 $Nm^3$), the temperature at the end-point was 1,651° C and the carbon content at the end-point was 0.09%.

In this example, the target temperature and target carbon content at the end-point were respectively 1,660° C and 0.10% and both the temperature and carbon content nearly hit the target values.

FIGS. 4*a* and 4*b* show by way of example the results obtained when the simultaneous control (temperature and carbon content) according to this invention was successively applied to the production of a number of heats. The following Table 1 shows the accuracy of control.

Table 1

| | Temperature | Carbon content | Simultaneous |
|---|---|---|---|
| $\bar{x}$ | 0.4° C | 0.001% | — |
| $\sigma$ | 0.5° C | 0.017% | — |
| Degree of hit | 81% | 73% | 63% |

Note:
1) For temperature, the accuracy of ±10° C was considered as a good hit.
2) For carbon content, the accuracy of ±0.02% was considered as a good hit.
3) The simultaneous hit means the case where both the temperature and carbon content at the targets for the same charge.
4) The temperature range at the end-point was 1,600 - 1,690° C.
5) The carbon content range at the end-point was 0.08 - 0.18%.
6) $\bar{x}$ = average value of accuracy
7) $\sigma$ = standard deviation of accuracy.

The following remarkable advantages result from the above-described greater accuracy of the control action:

1. By virtue of the fact that the carbon content of the steel bath can be controlled to the proper value, there is no danger of the oxygen content in the steel becoming abnormally high and the reduced non-metallic inclusions is ensured and moreover the steady yield of ferro alloys is ensured.

2. By virtue of the simultaneous control of the steel bath temperature and carbon content, the reduced after-blow and the reduced addition of coolant after the end point are ensured with resultant improvement in the steelmaking efficiency and productivity.

Most effective control action is achieved by controlling a coolant rather than by soft-blow controlling. When soft blow controlling is used, it is effected by selecting a proper type of soft-blow on the basis of the difference between $C_{EC}$ and $C_{EA}$, taking into consideration the relationship between the decarburization rate and the type of soft blow obtained from a series of tests carried out by changing in various ways the combination of the height of the lance and the pressure of oxygen.

It is usual in steel making operations to determine the proportion (or amount) of the materials to be charged, by forecasting the temperature of the molten steel at the end-point. The temperature at the end point is calculated on the basis of the material balance and heat balance in steel making.

The factors utilized in the calculation are as follows:

| input | output |
|---|---|
| 1. the amount of molten pig iron and the sensible heat thereof | 1. the amount of molten steel and the sensible heat thereof |
| 2. the amount of molten pig iron and the reaction heat thereof | 2. the amount of slag and the sensible heat thereof |
| 3. the amount of CO and the heat combustion thereof | 3. the amount of dust and the sensible heat thereof |
| 4. the amount of double salt formed and the heat of formation thereof | 4. the amount of exhaust gas and the sensible heat thereof |
| 5. the amount of FeC decomposed and the heat of decomposition | 5. the amount of iron ore and mill scale and the absorption of heat due to their decomposition |
| 6. the amounts of scrap and slagging agent and the sensible heat thereof | 6. the amount of combustion of CO in exhaust gas and the heat of combustion |
| 7. the amount of oxygen and the sensible heat thereof | 7. the amount of limestone and the absorption of heat due to decomposition thereof |
| | 8. the heat carried away by cooling water |
| | 9. others, as are well known |

The temperature of the molten steel at the end-point is nearly determined by properly adjusting the above input and output conditions. Such adjusting, though depending on the conditions of the factory, is obvious to those skilled in the art to which the present invention pertains. (For example, such an ordinary textbook as "Iron and Steel Making", Iron and Steel Institute of Japan, 1972, April 16, describes the basic adjusting technique).

In steel making the desired carbon content varies over a wide range from low carbon to high carbon. When low and medium carbon steels are desired to be produced, oxygen is blown in in an amount calculated to attain a carbon content of 0.50%, and when high carbon steels are desired to be produced, oxygen is blown in in an amount calculated to attain carbon contents from 0.50% up to 1.00%.

The amount of oxygen to be blow in may be determined by simple calculations, by those ordinarily skilled in the art, since the determination of said amount relates to an intermediate control. In the case of the present invention said amount of oxygen blown in may be calculated from the following equation:

$$Q_{BC} = (W_{CI} - W_{CB})/\overline{V} + Q'$$

in which $Q_{BC}$ = the amount of oxygen blown in by the time the measurement by a sensor is carried out ($m^3$);

$W_{CI}$ = the total amount of carbon initially contained in the charge (molten pig iron, cold pig iron and scrap) (kg);

$W_{CB}$ = the amount of carbon of 0.50% molten steel (kg);

$\bar{V}$ = the average decarburization rate determined by the actual results of the past operations, namely 0.890kgofC/Nm³; and $Q'$ = the amount of oxygen consumed for oxidizing Si, Mn and P (m³)

The above determination may be readily carried out by those skilled in the present art.

The quantity of oxygen blown in for raising the temperature up to an estimated level after the measuring is determined from equation (2). The "estimated level" is the "target temperature at the end-point". A calculated carbon content at the end-point is obtained from the equation (4) for $C_{EC}$.

We claim:

1. A method of controlling the temperature and carbon content of a molten steel bath at the end-point in an oxygen top-blown converter comprising the steps of:

determining the temperature of the molten steel at the end point as a function of at least the material balance and heat balance, and then assembling raw materials including molten pig iron, carbon monoxide and oxygen, for the molten steel bath in such quantity and relative proportions that the temperature of the molten steel bath at the end-point attains a temperature higher than a target temperature at the end-point;

blowing oxygen to the converter in an amount sufficient to attain a predetermined bath carbon content which is a function of the desired carbon content of the end product steel to be produced;

simultaneously measuring the temperature and carbon content of the molten steel by a single sensor upon completing the blowing of oxygen;

operating on said measured temperature and carbon content and determining a "forecast heating factor" in accordance with the following:

$$A' = \alpha_o + \alpha_1 E_o + \alpha_2 E_B + \alpha_3 E_{EA} + \alpha_4 E_L + \alpha_5 \Delta W_C + \alpha_6 \Delta W_{FE}$$

where $A'$ = forecast heating factor (Ton.°C/Nm³ of oxygen);

$E_O$ = calories possessed by initial charge (K cal);

$E_B$ = calories possessed by the charge at the time of measuring (K cal);

$E_{EA}$ = target calories possessed by the charge at the end point (K cal);

$E_L$ = loss calories between measurement and end-point (K cal);

$\Delta W_C$ = amount of decarburization (Ton);

$\Delta W_{Fe}$ = amount of oxidized molten iron (Ton); and $\alpha_o$, $\alpha_1$, $\alpha_2$, $\alpha_3$, $\alpha_4$, $\alpha_5$ and $\alpha_6$ are constants operating on said measured temperature and carbon content and determining decarburization parameters as follows:

$V$ = decarburization rate during the maximum decarburization period (KgC/Nm³ of oxygen);

$C_P$ = curve parameter(%); and $C_O$ = carbon content at critical decarburization (%);

further blowing in oxygen in a quantity derived from said forecast heating factor A' for raising the temperature of the molten steel bath up to a previously estimated temperature value after the measuring, the quantity of oxygen being further blown in being defined in accordance with the following:

$$\Delta Q = (W_T \cdot \Delta T)/A'$$

where $\Delta Q$ = the quantity of oxygen further blown in for raising the temperature up to the estimated temperature value after the measuring (Nm³);

$W_T$ = weight of total charge (Ton) at the time of the further blowing operation; and $\Delta T$ = temperature rise after measuring (° C) at the time of the further blowing operation;

determining the carbon content at the end-point of the process as a function of said oxygen quantity after the measuring and said decarburization parameters in accordance with the following:

$$C_{EC} = C_O + C_P \ln[1 + \left\{ \exp\left(\frac{C_B - C_O}{C_P}\right) - 1 \right\} \cdot \exp\left\{ -\frac{100V - \Delta Q}{W_{ST} - C_P} \right\}]$$

where $C_{EC}$ = calculated carbon content at the end-point (%);

$C_O$, $C_P$, $V$ = decarburization parameters;

$\Delta Q$ = the quantity of oxygen blown in for raising the temperature up to an estimated level after the measuring (Nm³); and $C_B$ = carbon content at the time of measuring (%); and carrying out at least one of the following: (i) still further blowing in a given quantity of oxygen $\Delta Q_c$ at the end-point, (ii) supplying a requisite amount of coolant $W_{Cl}$, and (iii) soft blowing in accordance with a given pattern of soft-blow, the given quantity of oxygen, the requisite amount of cooling and the soft-blow pattern being a function of the difference between said calculated carbon content at the end-point of the process and said target carbon content at the end-point, to simultaneously control the temperature and carbon content of said molten steel at the end-point of the process.

2. A method according to claim 1, wherein the step of simultaneously measuring the temperature and carbon content of the molten steel is carried out when the oxygen has been blown to the extent that the carbon content of the steel bath attains a predetermined value in the range 0.50 - 1.00% which is a function of the desired carbon content of the steel to be produced.

3. A method according to claim 1, wherein said sensor simultaneously measures the molten steel bath temperature and carbon content.

4. A method according to claim 1, wherein the decarburization rate is obtained from the following equation:

$$v = -\frac{d(W_{ST} \cdot \frac{C}{100})}{dQ} = V\left\{1 - \exp\left(-\frac{C - C_O}{C_P}\right)\right\}$$

where $v$ = decarburization rate (KgC/Nm³ of oxygen)

$W_{ST}$ = weight of molten steel (Kg)

$Q$ = integral oxygen quantity (Nm³)

$C$ = carbon content (%)

decarburization parameters;

$V$ = decarburization rate during maximum decarburization period (KgC/Nm³ of oxygen)

$C_P$ = curve parameter (%)

$C_O$ = carbon content at critical decarburization (%)

5. A method according to claim 1, wherein the oxygen quantity to be still further blown in at the end point is determined in accordance with $$\Delta Q_C = \frac{W_{st} \cdot C_P}{V} \ln \frac{\exp\left(\frac{C_B - C_O}{C_P}\right) - 1}{\exp\left(\frac{C_{EA} - CO}{C_P}\right) - 1}$$

where $\Delta Q_C$ is the finally corrected quantity of oxygen to be blown in after the measuring in replacement of the previously calculated $\Delta Q$.

6. A method according to claim 1, wherein the requisite amount of coolant is determined in accordance with $$\Delta W_{Ct} = \frac{\frac{A \cdot \Delta Q_C}{W_{ST}} - T_{EA} + T_B}{Z}$$

where $\Delta W_{Ct}$ is coolant quantity, (kg of coolant/ton of steel); $Z$ is the cooling capacity, (° C × ton of steel/kg of coolant); and the other symbols in equation (6) are the same as those previously defined.

* * * * *